US011503857B2

(12) United States Patent
Estrella

(10) Patent No.: US 11,503,857 B2
(45) Date of Patent: Nov. 22, 2022

(54) ALL-IN-ONE GRINDER, HEATER, AND INHALATION APPARATUS

(71) Applicant: David Estrella, Newark, NJ (US)

(72) Inventor: David Estrella, Newark, NJ (US)

( * ) Notice: Subject to any disclaimer, the term of this patent is extended or adjusted under 35 U.S.C. 154(b) by 442 days.

(21) Appl. No.: 16/687,393

(22) Filed: Nov. 18, 2019

(65) Prior Publication Data

US 2020/0154762 A1 May 21, 2020

Related U.S. Application Data

(60) Provisional application No. 62/768,608, filed on Nov. 16, 2018.

(51) Int. Cl.

| | |
|---|---|
| ***A24F 3/00*** | (2006.01) |
| ***A24F 1/24*** | (2006.01) |
| ***A24B 7/04*** | (2006.01) |

(52) U.S. Cl.

CPC ..... *A24F 3/00* (2013.01); *A24B 7/04* (2013.01); *A24F 1/24* (2013.01)

(58) Field of Classification Search

CPC ..... A24F 40/20; A24F 3/00

See application file for complete search history.

(56) References Cited

U.S. PATENT DOCUMENTS

| | | | | |
|---|---|---|---|---|
| 2015/0040928 | A1* | 2/2015 | Saydar | A61M 11/045 131/329 |
| 2015/0128971 | A1* | 5/2015 | Verleur | A61M 11/042 131/329 |
| 2017/0181470 | A1* | 6/2017 | Li | A24F 40/50 |
| 2017/0319009 | A1 | 11/2017 | Seckel et al. | |
| 2017/0368554 | A1 | 12/2017 | Nichols | |
| 2018/0014576 | A1 | 1/2018 | White | |
| 2020/0015510 | A1* | 1/2020 | Dong | A24F 40/46 |

FOREIGN PATENT DOCUMENTS

| | | | |
|---|---|---|---|
| WO | 2018029536 | A1 | 2/2018 |

* cited by examiner

*Primary Examiner* — Eric Yaary

(74) *Attorney, Agent, or Firm* — Gearhart Law LLC

(57) ABSTRACT

A smoking apparatus is provided. The smoking apparatus includes an outer casing, a grinder housed within the outer casing, configured to grind a raw material into a ground material, an oven housed within the outer casing, configured to heat the ground material, releasing smoke, and a ventilation compartment housed within the outer casing, configured to transport the smoke to an opening on the outer casing, enabling the smoke to exit the outer casing.

14 Claims, 4 Drawing Sheets

ALL-IN-ONE GRINDER, HEATER, AND INHALATION APPARATUS

CLAIM OF PRIORITY

This application is a United States utility application having priority to U.S. provisional application Ser. No. 62/768,608, filed Nov. 16, 2018 entitled "ALL-IN-ONE GRINDER, HEATER, AND INHALATION APPARATUS", the entirety of which is hereby incorporated by reference as if fully set forth herein.

FIELD OF THE EMBODIMENTS

This invention relates to a smoking apparatus and, in particular, to an all-in-one smoking apparatus incorporating a grinder, heater, and inhalation components.

BACKGROUND OF THE EMBODIMENTS

When preparing to smoke various types of plant material, there are multiple devices that may be required before the material can be smoked. These materials may include a grinder for grinding the plant material, a heater for heating the plant material to produce smoke, and inhalation devices for inhaling the smoke.

Having to use these multiple devices causes the smokers to carry excess materials and also increases the complexities involved in smoking. For at least these reasons, an apparatus is needed that incorporates these devices into a single apparatus that is easy to store, transport, and use.

Examples of related art are described below:

U.S. Patent Publication No. 2017/0319009 generally describes devices and methods for grinding, storing, and dispensing plant materials such as herbs, flowers, plants, seeds, and leaves, including legal *cannabis*, coffee, tea, and tobacco, and methods of manufacturing such devices. A modular grinder that can be assembled into multiple configurations and grinds, stores, and dispenses ground plant material is provided. Methods of grinding, storing, and dispensing plant material that employ the modular grinder are provided.

U.S. Patent Publication No. 2017/0368554 generally describes an integrated grinding and storage system for optimizing and enhancing plant performance for plant-based medical therapies and related uses of *cannabis* including an apparatus for grinding that includes a head operable to be removably attached to a receptacle or container. The head includes a magnet, an upper, inner grinding element, a lower grinding element, a shaft, and a neck sleeve. The upper, inner grinding element is in communication with the lower grinding element within the head. The grinding elements are operable to rotate relative to each other. The shaft extends between the upper and lower sections and magnetically couples with the grinding elements and orients them in relation to one another. The head may be manually or electrically activated.

U.S. Patent Publication No. 2018/0014576 generally describes pellet substrates configured for use with a vapor delivery device to vaporize and deliver an aerosol to a user that include porous, substantially inert activated carbon and activated alumina pellets that have generally spherical, semi-spherical and/or rounded shapes. The pellet substrates are formed by mixing the pellets together with a liquid solution of an aerosol former admixed with flavoring and/or nicotine, tobacco powder, or tobacco extract such that the liquid solution is absorbed into and/or adsorbed onto the porous structure of the pellets with or without the addition of heat. The pellets may be coated with an inert dry powder, such as calcium carbonate, to better adhere the liquid solution to the porous surfaces of the pellets. Alternatively, or in addition, the pellets may be coated with a liquid solution of a cellulose gum, such as sodium carboxymethylcellulose, and distilled water to reduce fracturing, cracking, chipping and dusting of the pellet substrates.

International Patent Publication No. WO2018/029536 generally describes systems, methods and apparatuses for vaporizing all or substantially all plant matter, liquid and/or other material to be vaporized are disclosed. Embodiments of the invention comprise a vaporization chamber sealed except for at least two conduits, heating element, a first conduit coupled to a source of fully or almost fully oxygenated gas, a heating element capable of heating the vaporization chamber to a temperature above a combustion temperature, a second conduit configured to transport vaporization gases and vaporized elements out of the vaporization chamber and at least one valve positioned in the second conduit preventing the flow of atmospheric air into the vaporization chamber. In some instances, the first gas substantially clears the vaporization chamber of atmospheric air prior to reaching combustion temperature. A second gas containing oxygen may be intermixed with the vaporization gases and vaporized elements proximal to the combustion chamber.

None of the art described above addresses all of the issues that the present invention does.

SUMMARY OF THE EMBODIMENTS

According to an aspect of the present invention, a smoking apparatus is provided. The smoking apparatus includes an outer casing, a grinder housed within the outer casing, configured to grind a raw material into a ground material, an oven housed within the outer casing, configured to heat the ground material, releasing smoke, and a ventilation compartment housed within the outer casing, configured to transport the smoke to an opening on the outer casing, enabling the smoke to exit the outer casing.

It is an object of the present invention to provide the smoking apparatus, wherein the smoking apparatus further includes a removable covering coupled to the outer casing, configured to enclose the raw material within the grinder.

It is an object of the present invention to provide the smoking apparatus, wherein the smoking apparatus further includes one or more securing mechanisms configured to secure the removable covering to the outer casing.

It is an object of the present invention to provide the smoking apparatus, wherein the one or more securing mechanisms includes one or more magnets.

It is an object of the present invention to provide the smoking apparatus, wherein the grinder is an herb grinder.

It is an object of the present invention to provide the smoking apparatus, wherein the smoking apparatus further includes a power supply.

It is an object of the present invention to provide the smoking apparatus, wherein the power supply is a battery.

It is an object of the present invention to provide the smoking apparatus, wherein the power supply is configured to power the grinder and the oven.

It is an object of the present invention to provide the smoking apparatus, wherein the smoking apparatus further includes a power switch configured to power on the smoking apparatus.

It is an object of the present invention to provide the smoking apparatus, wherein the smoking apparatus further includes a display.

It is an object of the present invention to provide the smoking apparatus, wherein the display is an LED display.

It is an object of the present invention to provide the smoking apparatus, wherein the display is configured to display one or more status updates on the smoking apparatus.

It is an object of the present invention to provide the smoking apparatus, wherein the raw materials are plant materials.

It is an object of the present invention to provide the smoking apparatus, wherein the grinder is coupled to the oven.

It is an object of the present invention to provide the smoking apparatus, wherein the grinder includes one or more openings configured to enable the ground material to pass from the grinder to the oven.

It is an object of the present invention to provide the smoking apparatus, wherein the oven includes one or more heating elements.

It is an object of the present invention to provide the smoking apparatus, wherein the smoking apparatus further includes a mouthpiece coupled to the ventilation compartment, configured to assist a user in inhaling the smoke.

DESCRIPTION OF THE PREFERRED EMBODIMENTS

Figure 1:
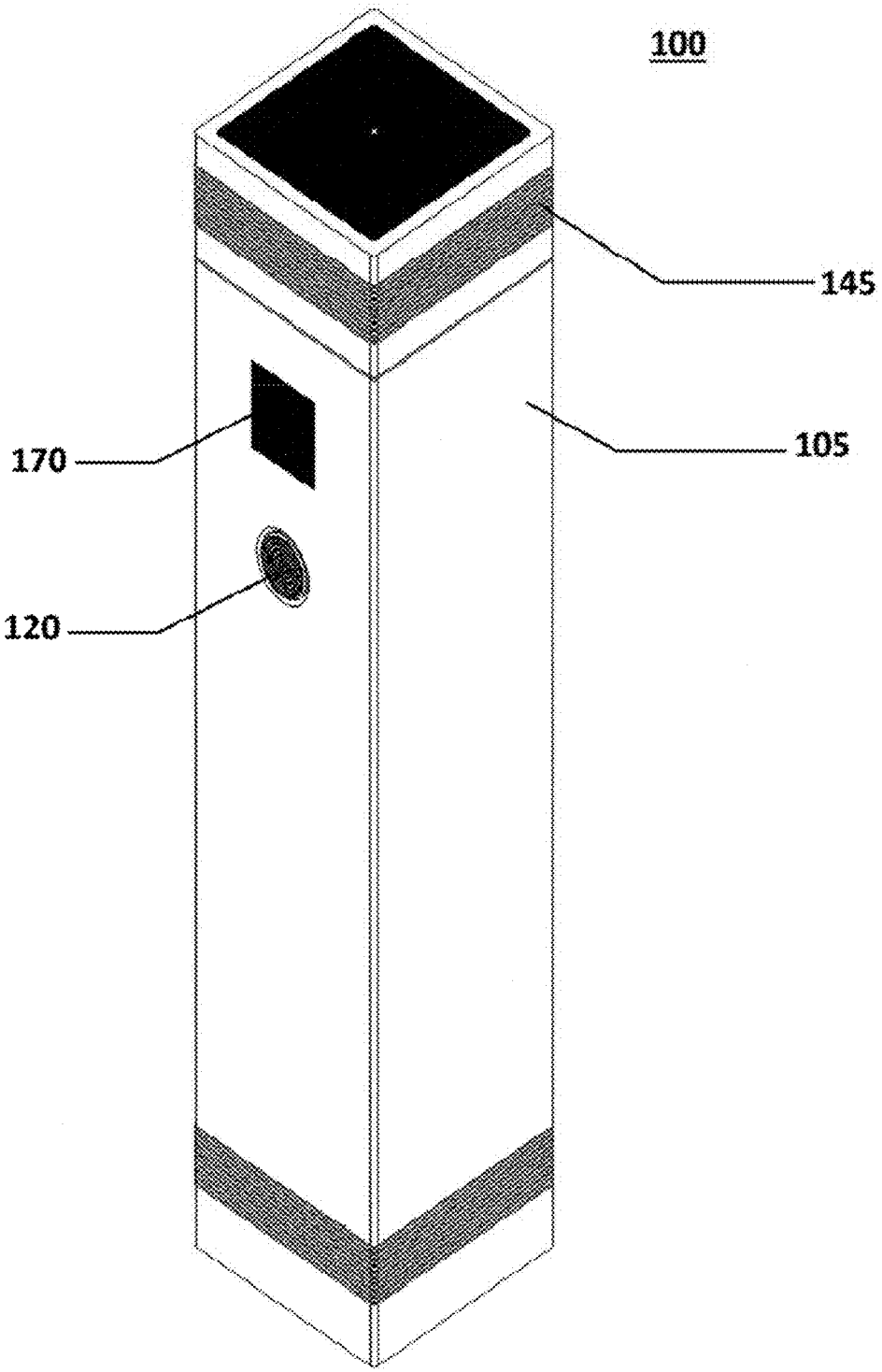
FIG. 1 shows a top perspective view of an all-in-one inhalation apparatus, according to an embodiment of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 2:
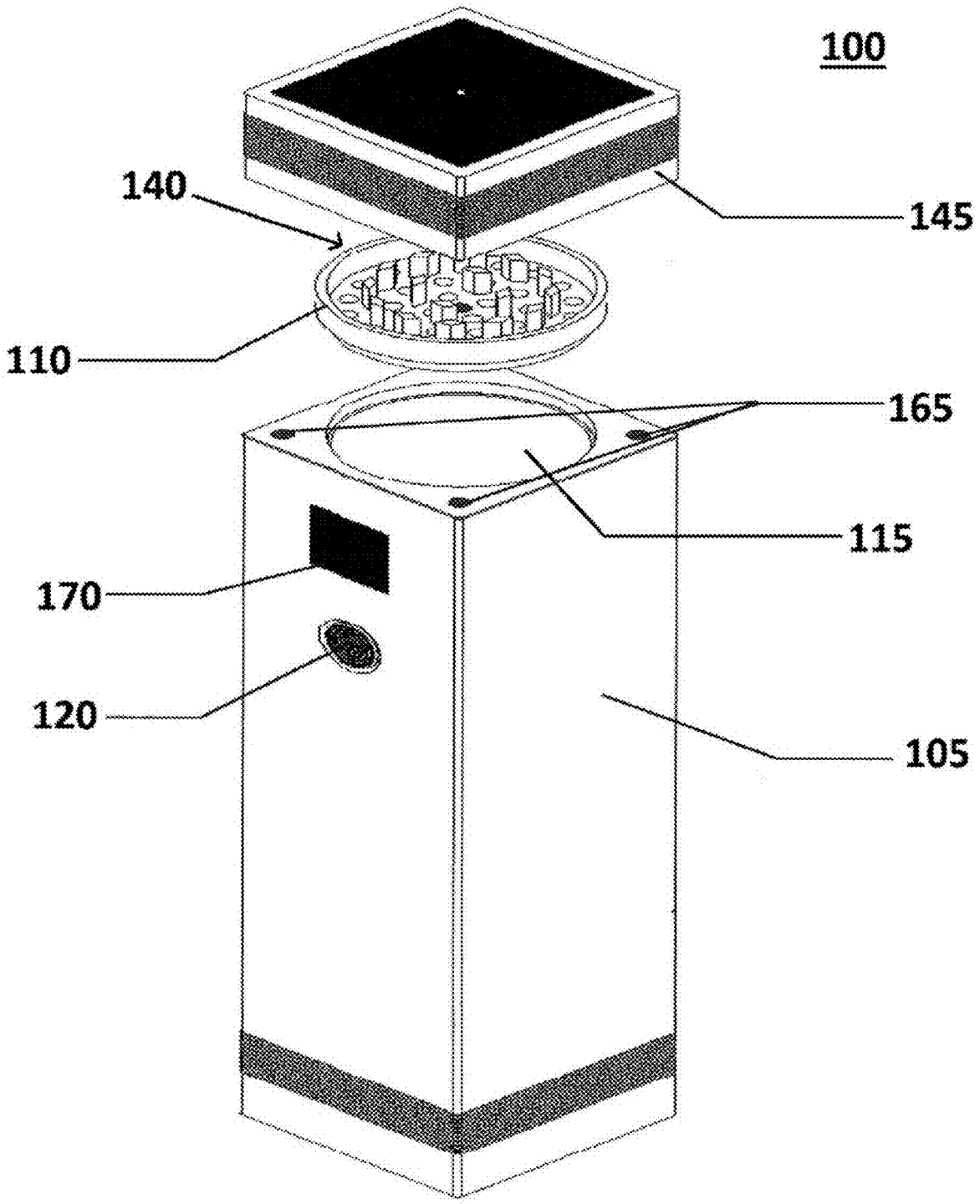
FIG. 2 shows an x-ray view of the all-in-one inhalation apparatus, according to an embodiment of the present invention.
Figure 3:
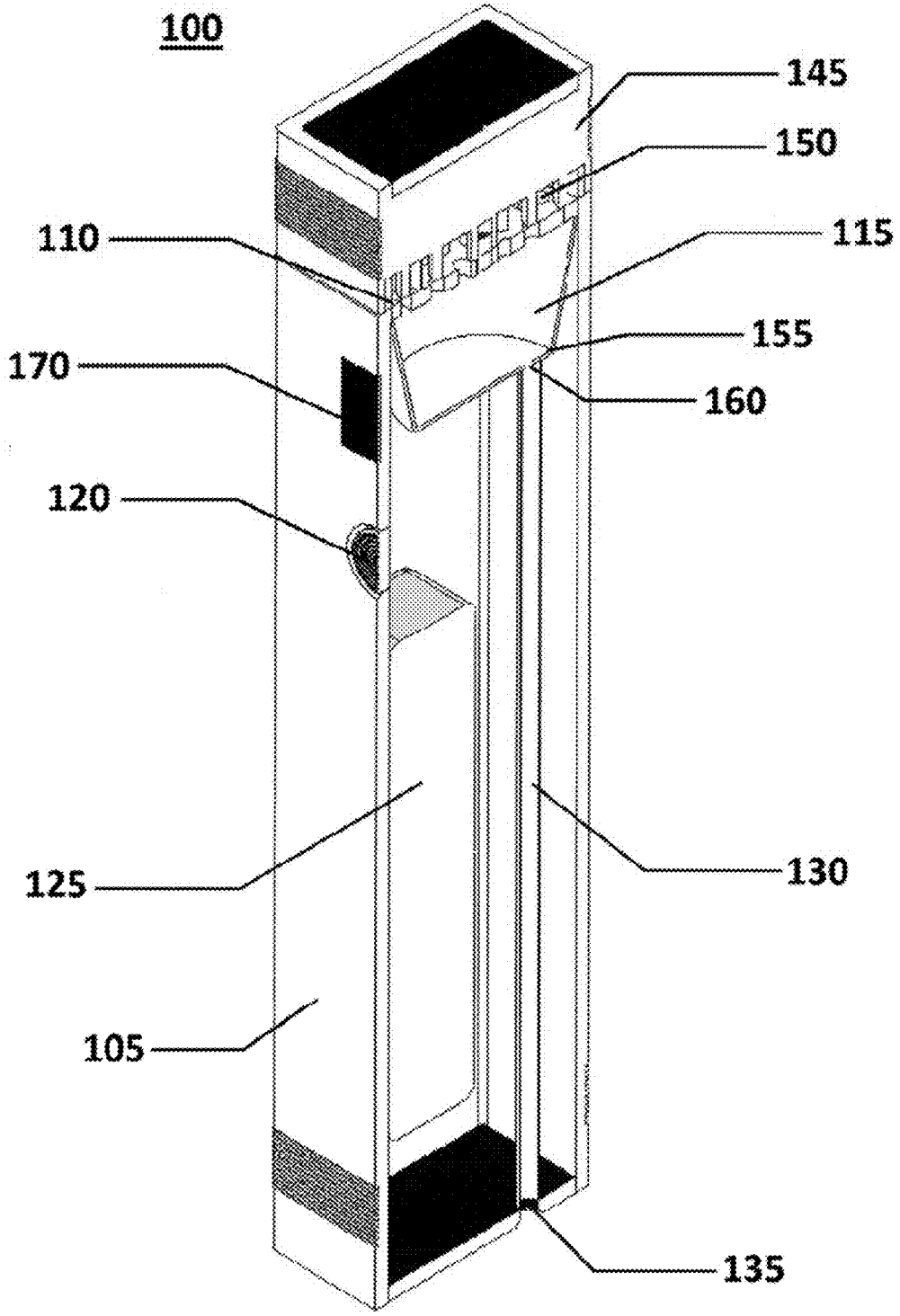
FIG. 3 shows an exploded view of the all-in-one inhalation apparatus, according to an embodiment of the present invention.
Figure 4:
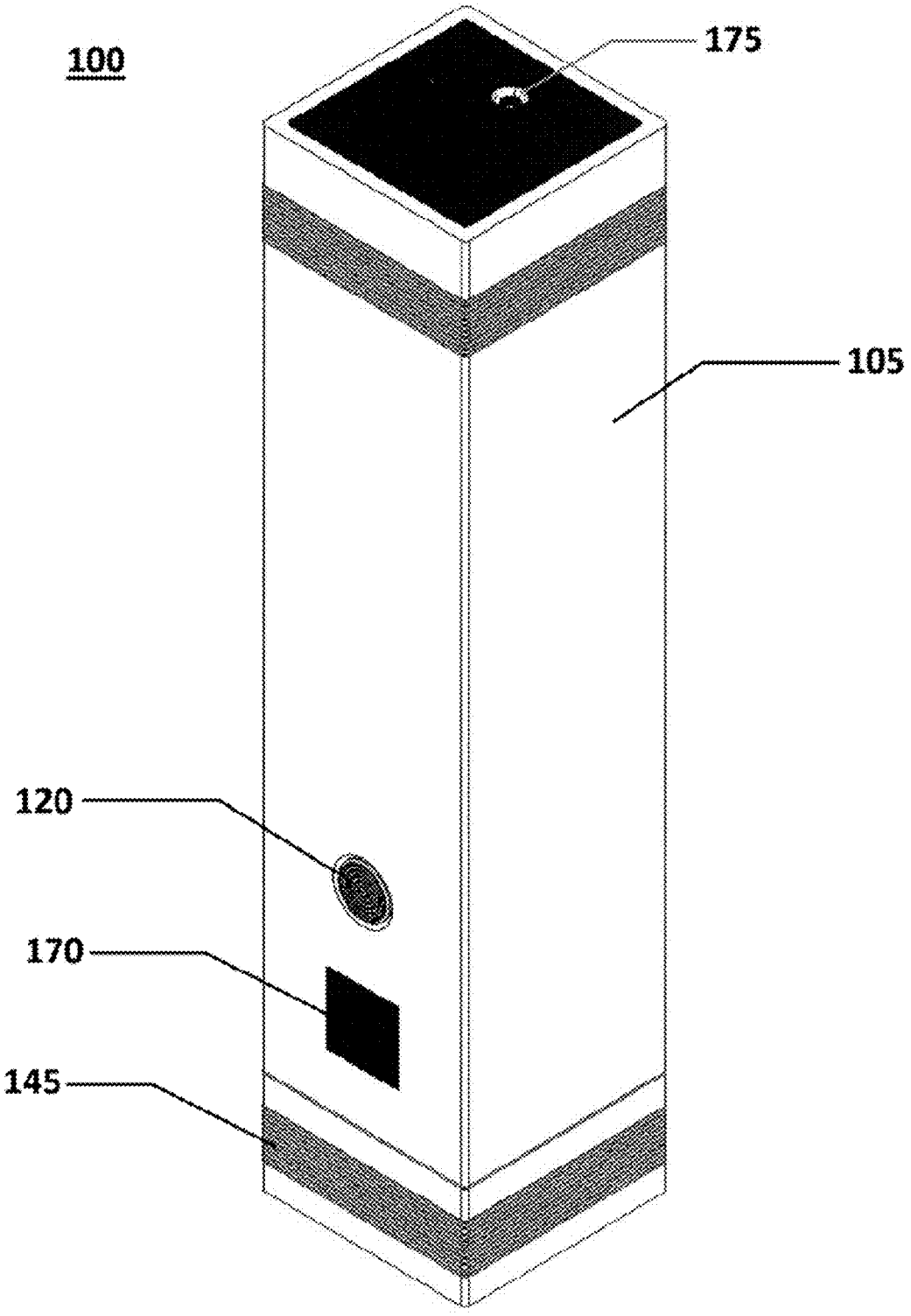
FIG. 4 shows a bottom perspective view of the all-in-one inhalation apparatus, according to an embodiment of the present invention.

Referring now to FIGS. 1-4, a top perspective view (FIG. 1), an x-ray view (FIG. 2), an exploded view (FIG. 3), and a bottom perspective view (FIG. 4) of an all-in-one inhalation or smoking apparatus 100, in accordance with an embodiment of the present invention.

According to an embodiment, the all-in-one inhalation apparatus 100 includes an outer casing 105, a grinder 110, an oven 115, a power switch 120, a power supply 125, and an internal ventilation compartment 130 for the transport of gaseous materials from the oven 115.

According to an embodiment, outer casing 105 includes an opening 140 configured to enable a user to insert one or more materials (e.g., plant or plant-based materials for smoking such as, but not limited to, tobacco, marijuana, etc.) into the grinder 110. According to an embodiment, the opening 140 is covered by a removable covering 145, enabling the grinder 110 to be sealed after insertion of the one or more materials and opened for removal of excess or discarded materials. According to an embodiment, the removable covering 145 is connected to the outer casing 105 via a hinged connection. According to an embodiment, the removable covering 145 is coupled to the outer casing 105 via one or more securing mechanisms 165. According to an embodiment, the one or more securing mechanisms 165 may be magnets, clips, buttons, snaps, and/or any other suitable form of securing mechanism 165. According to an embodiment, the all-in-one inhalation apparatus 100 further includes a display 170. The display 170 may be configured to display 170 to a user status updates pertaining to the usage of the all-in-one inhalation apparatus 100 (e.g., whether the all-in-one inhalation apparatus 100 is powered on, what function the all-in-one inhalation apparatus 100 is currently performing, etc.). According to an embodiment, the display 170 is an LED display.

According to an embodiment, the grinder 110 is an herb grinder and is configured to grind the one or more materials into smaller materials that are easier to burn in the oven 110. The grinder 110 may have internal protrusions for grinding the one or more materials and/or may include any suitable components for grinding the one or more materials.

According to an embodiment, once the one or more materials are ground in the grinder 110, the ground material is released into the oven 115. According to an embodiment, the grinder 110 is coupled to the oven 115. According to an embodiment, the grinder 110 and the oven 115 are connected via a barrier including a plurality of openings 150 wherein the plurality of openings 150 enable the ground material to pass from the grinder 110 to the oven 115.

According to an embodiment, once in the oven 115, the ground material is heated using a heating element 155 coupled to the oven 115, releasing smoke. According to an embodiment, the oven 115 includes an opening 160 between the oven 115 and the internal ventilation compartment 130, enabling the release of the smoke from the oven 115. According to an embodiment, the outer casing 105 further includes an opening 135 connected to the internal ventilation compartment 130, enabling the smoke (or other gaseous materials) to exit the outer casing 105 to be inhaled by a user. According to an embodiment, the opening 135 takes the form of a mouthpiece 175, enabling the user to easily inhale the gaseous material escaping from the all-in-one inhalation apparatus 100 through the ventilation compartment 130. According to an embodiment, the mouthpiece 175 is flush with the outer casing 105. According to an embodiment, the mouthpiece 175 protrudes from the outer casing 105. According to an embodiment, the all-in-one inhalation apparatus 100 is configured such that the grinder 110 can be removed from the oven 115, enabling access to the over for the removal of any waste products.

According to an embodiment, the all-in-one inhalation apparatus 100 includes a power supply 125. The power supply 125 may be an internal power supply (e.g., a battery) and/or may be an external power supply (e.g., a plug connected to an outlet). According to an embodiment, the power supply 125 may supply energy to power one or more of the grinder 110 and/or the oven 115. According to an embodiment, the all-in-one inhalation apparatus 100 powers on when the power switch 120 is engaged.

It is noted that the components of the all-in-one inhalation apparatus 100 within the outer casing 105 may be positioned in any suitable manner within the outer casing 105. For example, in the all-in-one inhalation apparatus 100 shown in FIG. 1, the grinder 110 is shown at an upper portion of the all-in-one inhalation apparatus 100. However, the grinder 110 may be located at any suitable location on the all-in-one inhalation apparatus 100.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A smoking apparatus, comprising:

an outer casing having a first end and a second end;

a removable covering configured to selectively cover and uncover the first end of the outer casing;

a grinder housed within the outer casing, configured to grind a raw material into a ground material, wherein the grinder has a plurality of openings in a base of the grinder configured to allow the ground material to pass through the grinder;

an oven housed within the outer casing, configured to heat the ground material received from the plurality of openings of the grinder, releasing smoke; and a ventilation compartment housed within the outer casing, wherein the ventilation compartment is coupled to the oven, and wherein the ventilation compartment is configured to transport the smoke from the oven to an opening on a second end of the outer casing, enabling the smoke to exit the outer casing.

2. The smoking apparatus as recited in claim 1, further comprising:

one or more securing mechanisms configured to secure the removable covering to the outer casing.

3. The smoking apparatus as recited in claim 2, wherein the one or more securing mechanisms includes one or more magnets.

4. The smoking apparatus as recited in claim 1, wherein the grinder is an herb grinder.

5. The smoking apparatus as recited in claim 1, further comprising: a power supply.

6. The smoking apparatus as recited in claim 5, wherein the power supply is a battery.

7. The smoking apparatus as recited in claim 5, wherein the power supply is configured to power the grinder and the oven.

8. The smoking apparatus as recited in claim 5, further comprising a power switch configured to power on the smoking apparatus.

9. The smoking apparatus as recited in claim 1, further comprising a display.

10. The smoking apparatus as recited in claim 9, wherein the display is an LED display.

11. The smoking apparatus as recited in claim 9, wherein the display is configured to display one or more status updates on the smoking apparatus.

12. The smoking apparatus as recited in claim 1, wherein the raw materials are plant materials.

13. The smoking apparatus as recited in claim 1, wherein the oven includes one or more heating elements.

14. The smoking apparatus as recited in claim 1, further comprising:

a mouthpiece coupled to the ventilation compartment, configured to assist a user in inhaling the smoke.

* * * * *